United States Patent [19]

Bosl et al.

[11] Patent Number: 4,969,346

[45] Date of Patent: Nov. 13, 1990

[54] APPARATUS FOR PRODUCING COLD ROLL-FORMED STRUCTURES

[75] Inventors: George F. Bosl, Westlake; Patrick M. Kelly, Cleveland; Dennis A. Alvarez, Euclid, all of Ohio; Gale Sauer, Sinclairville, N.Y.; Joseph A. Hocevar, Willoughby Hills, Ohio

[73] Assignee: USG Interiors, Inc., Chicago, Ill.

[21] Appl. No.: 382,099

[22] Filed: Jul. 19, 1989

Related U.S. Application Data

[60] Division of Ser. No. 197,622, May 23, 1988, Pat. No. 4,881,355, which is a division of Ser. No. 19,214, Feb. 26, 1987, Pat. No. 4,770,018, which is a continuation-in-part of Ser. No. 838,918, Mar. 12, 1986, abandoned.

[51] Int. Cl.[5] ..... B21B 15/00; B21D 13/04

[52] U.S. Cl. ..... 72/177; 72/180; 72/181

[58] Field of Search ..... 72/176–182, 72/46, 199, 234, 235, 385, 366, 379, 377, 127, 204, 224, 225; 29/150, 155 R

[56] References Cited

U.S. PATENT DOCUMENTS

| | | | |
|---|---|---|---|
| 1,814,593 | 7/1931 | Gersman . | |
| 1,939,356 | 12/1933 | Lindgren | 72/83 |
| 2,027,215 | 1/1936 | Williams | 72/181 |
| 2,085,829 | 7/1937 | Rogers . | |
| 3,187,534 | 6/1965 | Kalpakcioglu . | |
| 3,205,688 | 9/1965 | Paulton | 72/83 |
| 3,209,432 | 10/1965 | Cape | 52/720 |
| 3,393,547 | 7/1968 | Kortan | 72/180 |
| 3,488,989 | 1/1970 | Rakich . | |
| 4,055,979 | 11/1977 | Kraft | 72/83 |
| 4,087,226 | 5/1978 | Mercer | 425/397 |
| 4,204,416 | 5/1980 | Chumanov | 72/204 |
| 4,233,833 | 11/1980 | Balinski | 72/180 |
| 4,241,146 | 12/1980 | Sivachenko | 72/180 |
| 4,317,350 | 3/1982 | Sivachenko | 72/177 |
| 4,578,979 | 4/1986 | Abe | 72/177 |
| 4,815,201 | 3/1989 | Harris | 29/727 |

FOREIGN PATENT DOCUMENTS

| | | | |
|---|---|---|---|
| 20754 | 2/1976 | Japan | 72/204 |
| 103702 | 6/1982 | Japan | 72/235 |
| 55102 | 1/1983 | Japan | 72/176 |
| 209402 | 11/1984 | Japan | 72/366 |
| 505447 | 3/1976 | U.S.S.R. | 72/366 |
| 1015961 | 5/1983 | U.S.S.R. . | |
| 898143 | 6/1962 | United Kingdom | 72/180 |
| 961649 | 6/1964 | United Kingdom | 72/182 |

*Primary Examiner*—Daniel C. Crane

*Attorney, Agent, or Firm*—Pearne, Gordon, McCoy & Granger

[57] ABSTRACT

A cold-forming method is disclosed for thinning localized, longitudinally extending portions of sheet metal by lateral shear deformation without any substantial longitudinal deformation. With such method, it is possible to produce elongated members which are thinned in zones of low stress and are thicker in zones of higher stress so as to provide high metal use efficiency. The method is performed by an apparatus including a rotating mandrel providing opposed conical surfaces and pressure rolls operable to apply forces substantially perpendicular to the axis of rotation of the mandrel to cause a portion of the sheet metal to yield in shear to reduce the thickness of longitudinally extending portions of the sheet metal. The forces are applied in a plane normal to the length of the strip in order to avoid longitudinal elongation.

8 Claims, 9 Drawing Sheets

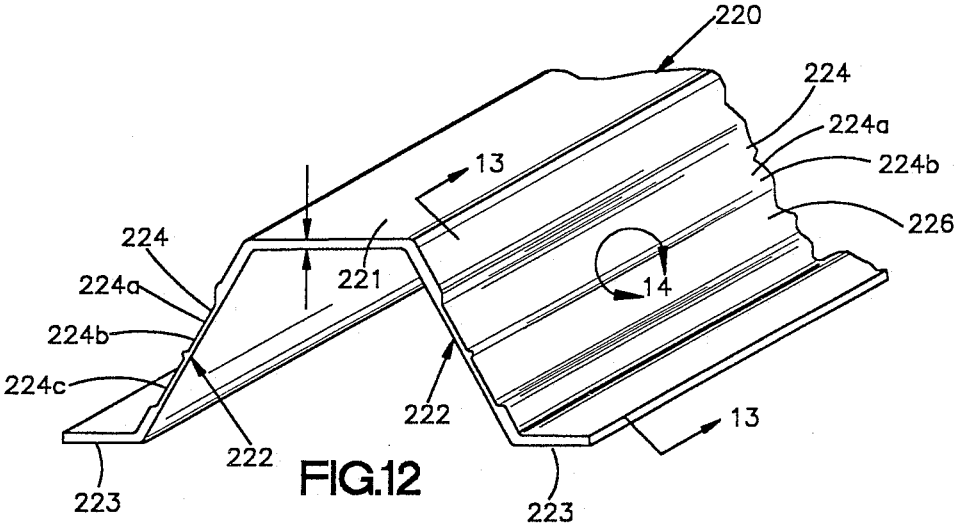
FIG.12
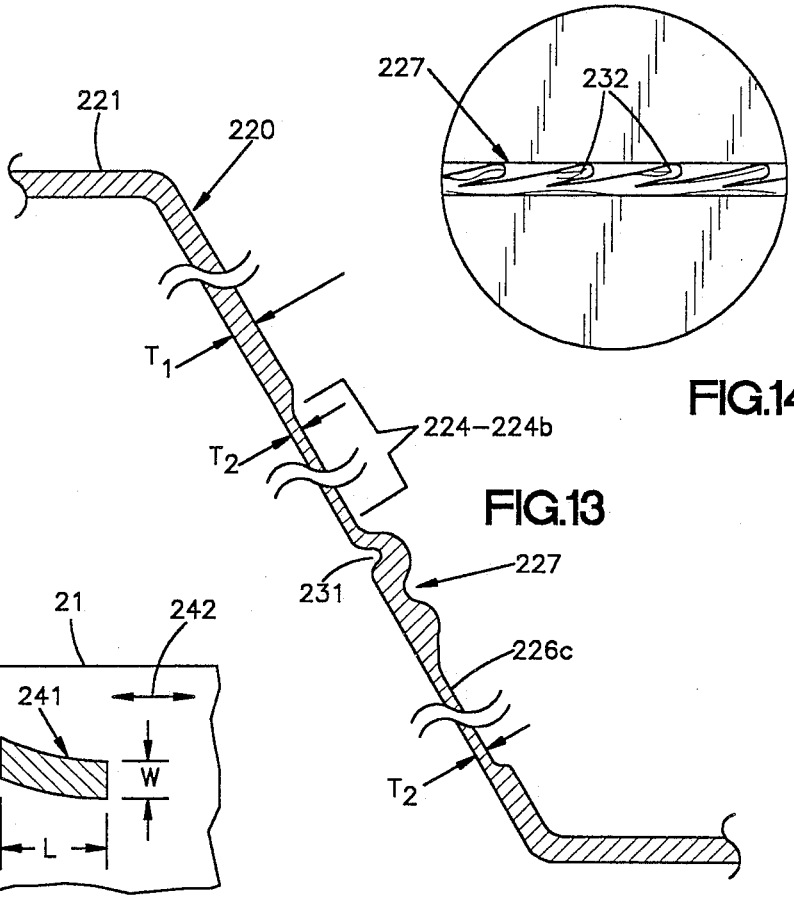
FIG.13
FIG.14
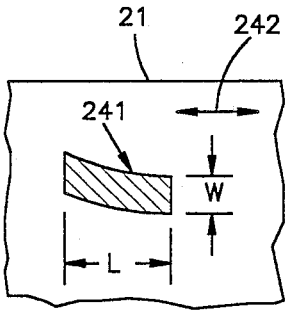
FIG.19

APPARATUS FOR PRODUCING COLD ROLL-FORMED STRUCTURES

This is a division of application Ser. No. 07/197,622, filed May 23, 1988, now U.S. Pat. No. 4,881,355, which is in turn a division of application Ser. No. 07/019,214, filed Feb. 26, 1987, (now U.S. Pat. No. 4,770,018 issued Sept. 13, 1988), which is in turn a continuation-in-part of application Ser. No. 06/838,918, filed Mar. 12, 1986 (now abandoned).

BACKGROUND OF THE INVENTION

This invention relates generally to cold rollforming of metal strip, and more particularly to continuous cold-rolling methods and apparatus for making metal strip which is thinned lengthwise to form laterally spaced zones of different thickness and to products produced from such strip.

Many elongated structures are formed of sheet metal which is roll-formed to a desired cross section. Examples include, but are not limited to, grid tees for suspension ceilings, metal wall studs and corrugated sheet metal. Further, in many instances, the use of the structure is such that more efficient utilization of the material forming the structure is obtained if the metal can be concentrated at specific locations within the structure.

For example, a grid tee for suspension ceilings usually provides a bulb along one edge and flanges along the opposite edge. The bulb and flanges are interconnected and maintained in a spaced relationship by a central web. In such a grid tee structure, the bulb and flanges provide the principal structural strength, and the web does not contribute very much to the strength of the structure. The main function of the web is to maintain the spacing between the bulb and the flanges. Therefore, the efficient utilization of the material of the grid tee is improved if the web thickness is reduced and the material forming the grid tee is concentrated in the grid extremities at the bulb and flanges.

U.S. Pat. No. 4,206,578, assigned to the assignee of the present invention, describes a grid tee in which material is concentrated at the extremities and the advantages derived therefrom. Such patent is incorporated herein by reference.

Efficient material use is also obtained in a generally similar manner if the webs of metal studs and channels are reduced in thickness compared to the thickness of the extremities of the structure. Likewise, corrugated sheets having thin connecting webs provide, in many instances, improved efficiency of material use.

Generally in the past it has been impossible or impractical to cold roll the strips of metal to provide a strip in which selected lengthwise portions have reduced thickness and other portions remain at the greater original thickness. For example, the roll-forming of the I-beam has been performed "hot," that is, at a temperature above the recrystallization temperature, so that the material forming the beam is highly plastic before it is rolled. Other non-uniform cross section forms are also usually produced by extrusion or rolling in the hot state.

In a typical cold roll-forming operation in which thickness is changed, a strip of sheet or plate material is passed between two opposed rolls which apply pressure to the opposite surfaces of the material and plastically deform it to a reduced thickness. During such conventional rolling, the strip material flows primarily in a longitudinal direction, causing increased length of the strip. There is no problem involved if the reduction in thickness is to be accomplished in a uniform manner across the entire width of the strip, since the elongation tends to be uniform across the entire width of the strip.

On the other hand, if a conventional cold rolling operation were attempted to be employed to reduce the thickness of a longitudinal portion of the strip while leaving the remaining longitudinal portions at their original thickness, serious difficulties would be encountered because the reduced thickness portion would tend to expand lengthwise of the strip, while the unreduced or unthinned portions would not. This would cause the strip to curl and buckle and lose any semblance of straightness. Therefore, such an operation cannot be used to produce structures of the general type described above.

U.S. Pat. No. 4,233,833 proposes a system for forming strips of sheet metal by a roll-forming procedure so that selected lengthwise portions of the sheet are reduced in thickness, while other portions remain at the original thickness. In such patent, a method is disclosed in which a strip of material is passed over opposed corrugating rolls, while the edges of the material are laterally held a fixed distance apart. Such method purports to apply lateral tension in the material being corrugated, causing it to stretch laterally and reduce in thickness. The patent further describes the step of subsequent flattening of the corrugations. It is not believed that the method disclosed in such latter patent has ever been developed or commercially used.

DISCLOSURE OF THE INVENTION

The present invention is directed to the manufacture of cold rolled metal articles in which substantial reductions in the metal content of the articles are obtained without materially affecting the strength or utility of the articles to any substantial extent, and to the method and apparatus of such manufacture. The process of the invention is preferably carried out at room temperature, although it is contemplated that for some applications the metal may be heated to a selected temperature below the recrystallization temperature. Therefore, as used herein, the terms "cold-forming" or "cold-rolling" are intended to include working at temperatures below the recrystallization temperature of the metal, and preferably mean working at room temperature.

One main aspect of the present invention is the provision of a new concept of cold-rolling that makes it possible to produce metal strip having laterally spaced portions or bands of different thickness extending lengthwise of the strip without causing the strip to curl or buckle. The new process is characterized by the steps of applying to the surface of the strip a shear force which is inclined relative to such surface and is contained in a plane substantially normal to the length of the strip so that the force does not have any significant longitudinal component in order to cause shear deformation and consequent thinning of the metal without substantial lengthwise deformation; and causing relative movement of the shear force along the length of the strip to produce a thinned lengthwise extending band or portion which is thinner than the adjacent portions of the strip.

In one especially preferred illustrated embodiment, the shear forces are applied at spaced work stations along the length of the strip to laterally adjacent portions of the metal of the strip so as to progressively widen the band of reduced thickness.

In accordance with another especially preferred illustrated embodiment, the shear forces are sequentially applied at a limited number of spaced work stations along the length of the strip to laterally adjacent portions of the strip to form a first thinned portion or band. Thereafter, an unthinned portion adjacent to the first thinned band is skipped over and shear forces are again applied beyond the skipped portion in a similar sequential manner to produce a second thinned portion or band laterally spaced from the first associated band by the portion which is skipped over. Such skipping process is repeated until the desired total width of thinned bands is obtained. In such embodiment, two or more associated thinned portions or bands are produced which are spaced from the next adjacent band by a relatively narrow, unthinned portion.

In both illustrated embodiments, the deforming pressure is applied by rotating mandrels and rotating pressure rolls structured to apply deforming pressure to the strip along narrow, elongated deforming zones extending in a direction substantially aligned with the length of the strip material. Because the length of the deforming zones substantially exceeds its width, the frictional forces applied by the mandrels and pressure rolls restrain the metal flow in a longitudinal direction and cause the metal to flow substantially in a lateral direction which is the direction of least resistance to flow.

Further, in both embodiments, the metal is confined along one lateral side of the deforming zone to restrain lateral flow toward such side and cause almost the entire lateral flow to occur in the other lateral direction.

In such especially preferred embodiments, the shear forces applied at the spaced work stations are inclined with respect to the surface of the material of the strip at an angle which is maintained constant at each work station and the magnitude of the shear forces is preferably controlled so that the material of the strip is deformed to a minimum thickness equal to the original strip thickness times the sine of such angle. It has been found that detrimental longitudinal flow and cracking of the metal along the band of reduced thickness can be minimized by limiting the amount of thinning to that stated. However, satisfactory results have been achieved in some instances when the thinning of the band substantially exceeded the sine formula.

The above-described methods of the invention can be practiced using high speed cold-rolling apparatus to produce a metal strip of indefinite length having portions remaining at the original thickness and portions extending lengthwise of the strip having a reduced thickness substantially less than the original thickness. The thinning is accomplished without any substantial elongation of the thinned material in the direction of the length of the strip, so that flatness and straightness of the strip material are not impaired to any significant extent. Further, the shear deformation and thinning can be performed by the application of balanced lateral forces to the strip, thereby reducing any strip guiding or retaining problems.

In accordance with another aspect of this invention, a novel and improved method is provided for producing elongated structural elements in which the metal of the element is thinned by shear deformation in zones of relatively low stress and is concentrated in zones of high stress so as to provide improved and efficient metal usage.

In accordance with still another aspect of this invention, a novel and improved method of manufacturing elongated structural elements is provided in which longitudinal portions of the element are thinned and work hardened during the process of manufacture thereof, so as to provide efficient metal usage in such elements.

In accordance with another aspect of this invention, a method of thinning longitudinally extending portions of coated elongated strips is provided which allows such reduction to occur after coating of the strip and without excessive damage to the coating thereof.

In accordance with another aspect of this invention, an elongated strip of sheet metal is provided in which longitudinally extending portions of the strip are thinned by shear deformation.

In accordance with still another aspect of this invention, a novel and improved grid tee for a suspension ceiling is provided in which the metal forming the web of the tee is thinner than the metal forming the bulb and flange thereof.

In accordance with another aspect of this invention, a novel and improved stud structure is provided in which efficient utilization of the metal content of the stud is achieved by providing a shear deformed and thinned web section.

In accordance with another aspect of this invention, a novel and improved corrugated metal structure is provided in which surface portions have one thickness and connecting web portions are of a reduced thickness.

In accordance with another aspect of this invention, a novel and improved apparatus is provided for performing the processes mentioned above.

These and other aspects of this invention are illustrated in the accompanying drawings, and more fully described in the following specification.

BRIEF DESCRIPTION OF THE DRAWINGS

FIG. 12 is a perspective view of a portion of an elongated strip of metal similar to the strip illustrated in FIG. 1 but produced in accordance with the second illustrated embodiment of this invention;

FIG. 13 is an enlarged, fragmentary section taken along line 13—13 of FIG. 12;

FIG. 14 is an enlarged view of the circled portion indicated in FIG. 12, illustrating the herringbonelike structure resulting along the unthinned portion located between two adjacent thinned portions or bands;

FIG. 19 is an enlarged view of the zone of deformation along which the rolls deform the metal strip.

Best Mode for Carrying Out the Invention

FIGS. 1 through 11 illustrate a first especially preferred embodiment of this invention, which will be described first.

Figure 1:
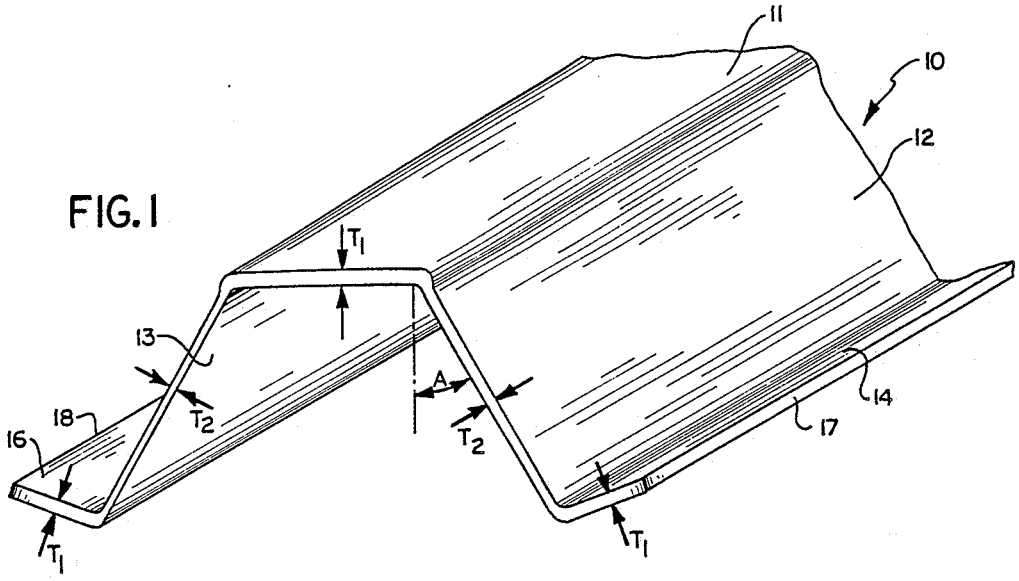
FIG. 1 is a perspective view of a portion of an elongated strip of metal in accordance with the present invention having thinned, longitudinally extending portions.
Figure 2:
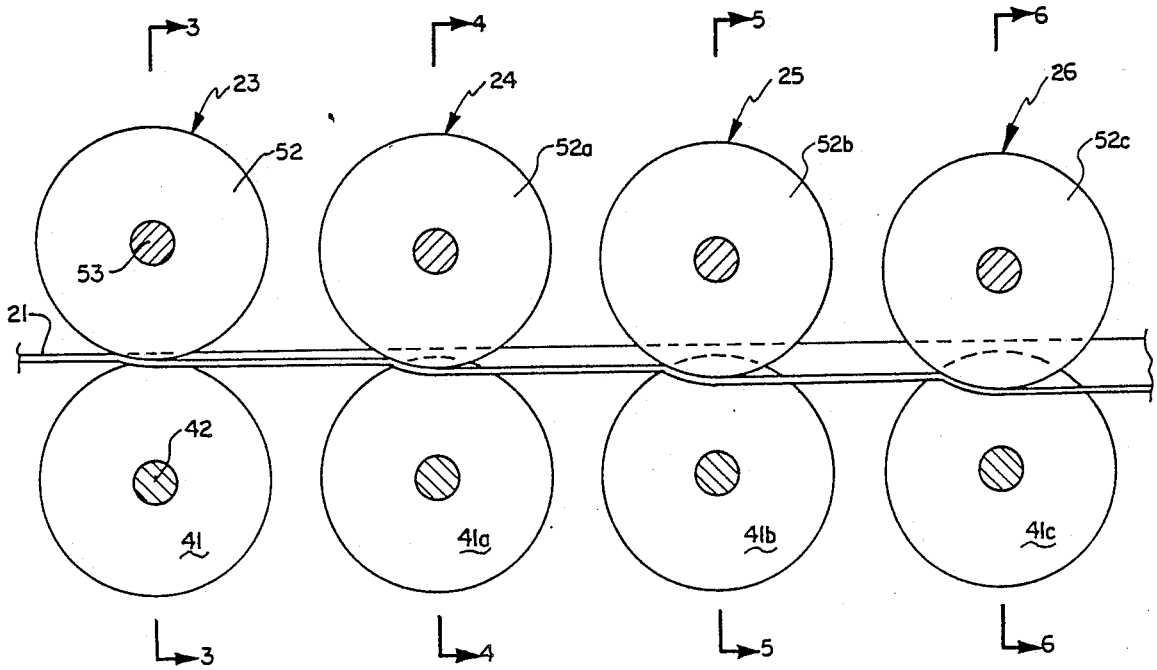
FIG. 2 is a side elevation schematically illustrating a machine for forming the strip of metal illustrated in FIG. 1.

Referring now to the drawings, FIG. 1 illustrates an elongated member 10 produced in accordance with the invention from a strip of sheet metal by shear deformation. The invention, when used to produce grid tees for suspension ceilings and the like, is preferably practiced using relatively thin material on the order of 0.020 inches or less. However, this invention may also be applied to thicker metal, and the term "sheet metal" is intended to include relatively thick material sometimes referred to as "plate." As shown, the member 10 has a flat central wall portion 11 and laterally outwardly diverging wall portions 12, 13 which terminate in edge flange portions 14, 16, respectively. The two edge flange portions 14, 16 are displaced laterally outwardly from the central wall portion 11 and are substantially perpendicular to the associated wall portions 12, 13.

The central wall portion 11 and the edge flange portions 14, 16 have a thickness $T_1$ which is substantially equal to the original thickness of the strip from which the member 10 is formed. The diverging walls 12, 13 have a reduced thickness $T_2$ produced by deformation of the metal and are harder than the remaining portions because of the work hardening that occurs during the deformation and thinning operation.

As shown, the wall portions 12, 13 diverge by an angle A from a plane perpendicular to the central wall portion 11. According to the preferred method of manufacture, the thickness $T_2$ is equal to or exceeds $T_1$ sine A. As more fully explained below, it has been found that the tendency for undesirable longitudinal flow or cracking of the wall portions 12, 13 is minimized by limiting the amount of thinning to that determined by the sine formula. In instances in which the wall portions 12, 13 are shear deformed and thinned to a thickness $T_2$ which substantially equals $T_1$ sine A, the width of the member 10, i.e., the lateral spacing between the edges 17, 18 of the flanges 14, 16, is substantially equal to the initial width of the strip of metal used to form the member.

Reference is now made to FIGS. 2–6, which schematically illustrate the method and apparatus for continuously cold-rolling a strip of sheet metal 21 into the configuration of member 10. The illustrated apparatus includes four work stations 23–26, although, a smaller or larger number of stations can be provided depending upon the particular application and the size of part to be produced. The deforming operations shown in FIGS. 2–6 are somewhat exaggerated in order to better illustrate and describe the metal working steps that are involved.

Figure 3:
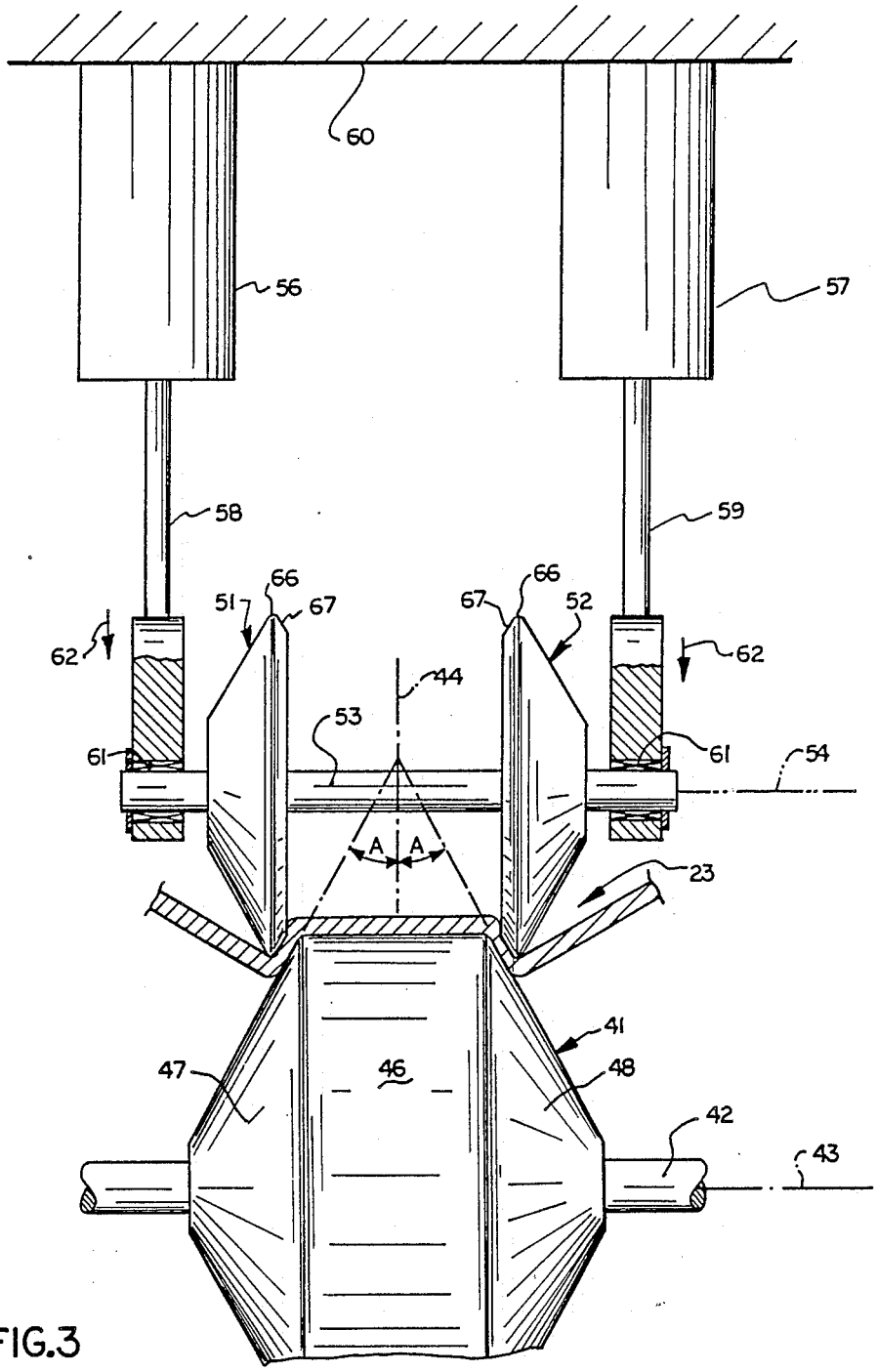
FIGS. 3, 4, 5 and 6 are schematic, fragmentary cross sections taken along the corresponding section lines of FIG. 2 and progressively illustrating the formation of the strip of material shown in FIG. 1.

A rotatable mandrel 41 is provided at the work station 23. As shown in FIG. 3, the mandrel 41 is in the form of a roller mounted on a power driven shaft 42. The mandrel 41 has a central, cylindrical, peripheral surface 46 and frustoconical side surfaces 47, 48. The angle between each frustoconical surface 47, 48 and the vertical central plane 44 of the mandrel 41 is equal to the angle A discussed above in connection with FIG. 1, while the width of the cylindrical surface portion 46 is equal to the width of the central wall portion 11 of member 10 illustrated in FIG. 1.

A pair of pressure rolls 51, 52 are positioned above the mandrel 41 at the work station 23. The two rolls 51, 52 are identical, but of opposite hand, and are mounted on a common shaft 53 at locations equally spaced from the central plane 44. The shaft 53 is journaled for rotation about its axis 54 and is supported so that the axis 43 of the shaft 42 and the axis 54 are contained within a single vertical plane.

A pair of hydraulic piston-cylinder actuators 56, 57 are provided to apply a force on the pressure rolls 51, 52 toward the cooperating mandrel 41. The hydraulic actuators 56, 57 include cylinders mounted on the machine frame 60 and pistons rods 58, 59 which are connected through bearings 61 to the ends of the shaft 53. When the actuators 56, 57 are pressurized, they exert a downward force indicated by the arrows 62 on the shaft 53 near the rolls 51, 52.

Figure 3A:
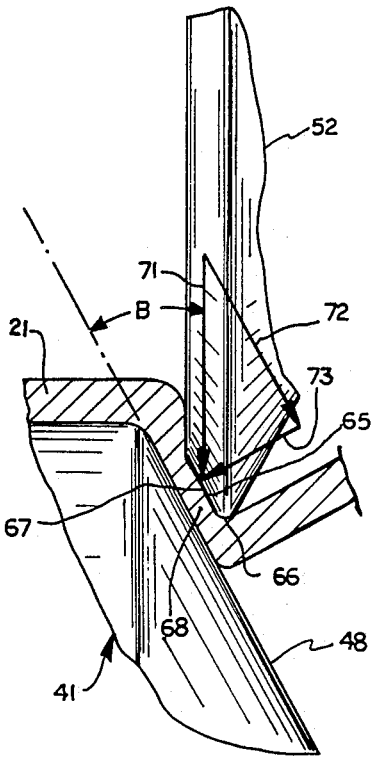
FIG. 3*a* is an enlarged, fragmentary section of a portion of the structure shown in FIG. 3, illustrating the application of the shear forces to the strip of metal.

The two pressure rolls 51, 52 have a peripheral shape designed to initiate shear deformation of the metal strip 21. The description of the roll 52, which is best shown in FIG. 3*a*, applies equally to the pressure roll 51, since both rolls are identical in shape although oppositely facing. As illustrated in FIG. 3*a*, the periphery of the roll 52 has a radius portion 66 of maximum diameter. Extending radially inwardly from the radius portion 66 is a frustoconical working face 67 which cooperates with the surface 48 of the mandrel 41. As shown, the frustoconical working surface 67 is parallel to the cooperating working surface 48 of the mandrel 41. However, non-parallel cooperating working surfaces may be used in some instances.

In operation the continuously moving strip 21 enters the gap between the working surfaces 67 of the two pressure rolls 51, 52 and the corresponding conical surfaces 47, 48 of the mandrel 41, and sufficient force is applied by the actuators 56, 57 to cause the metal to yield and deform in shear to generate a thinned band 68 extending lengthwise of the strip. The band 68 is thinned to a thickness $T_2$ which corresponds to the thickness of the wall portions 12, 13 of the member 10 described above in connection with FIG. 1.

The shear deformation of the strip 21 to produce the band 68 does not cause any significant longitudinal lengthening of the strip, and consequently curling or buckling problems are avoided. The manner in which this is accomplished is diagrammatically illustrated in FIG. 3*a*. The force of the pressure roll 52 is applied in the direction of the arrow 71. The shear force 71 applied by the pressure roll 52 is inclined relative to the adjacent outer surface 65 of the strip 21 and lies in a plane substantially normal to the longitudinal axis of the strip, so that the force has no significant longitudinal component. As shown, the force 71 can be resolved into a component 72 parallel to the outer surface 65 of the strip 21 and a component 73 normal to such surface.

When the two shafts 42, 53 are parallel, the shear force 71 applied to the metal strip 21 by the pressure roller 52 is inclined relative to the surfaces 48 and 65 by an angle B. In the illustrated preferred embodiment of the apparatus, the angle B is equal to the angle A discussed above in connection with member 10 shown in FIG. 1.

When shear deforming metal in accordance with the invention, the amount of thinning of the band 68 is a function of the size of the force 71 applied to the metal by the pressure roll 52. It has been found that the maximum ratio of reduction $T_2/T_1$, where $T_1$ is the initial thickness of the metal strip and $T_2$ is the thickness of the band 68 after shear deformation, preferably should not exceed the sine of angle B in order to avoid cracking or longitudinal flow of the shear deformed metal. If, for example, a 50% reduction in thickness is desired, the cooperating roll preferably should be configured so that the sine of the angle B is no greater than 0.5. This requires that the angle B be equal to or less than 30°. When the invention is carried out so that $T_2$ is equal to $T_1$ sine B and, in turn, is equal to $T_1$ sine A, the total lateral width of the strip 21 after shear deformation is substantially equal to the starting width of the strip. This feature may be advantageous when forming corrugated sheet metal as described below.

Figure 4:
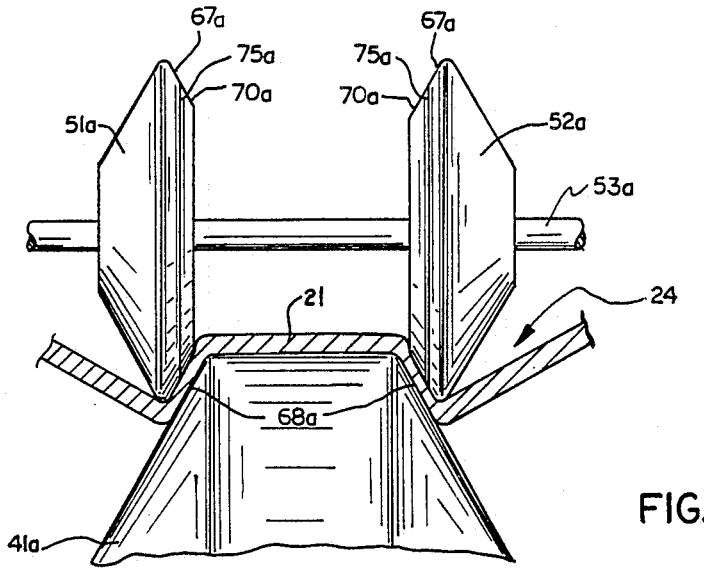
Figure 5:
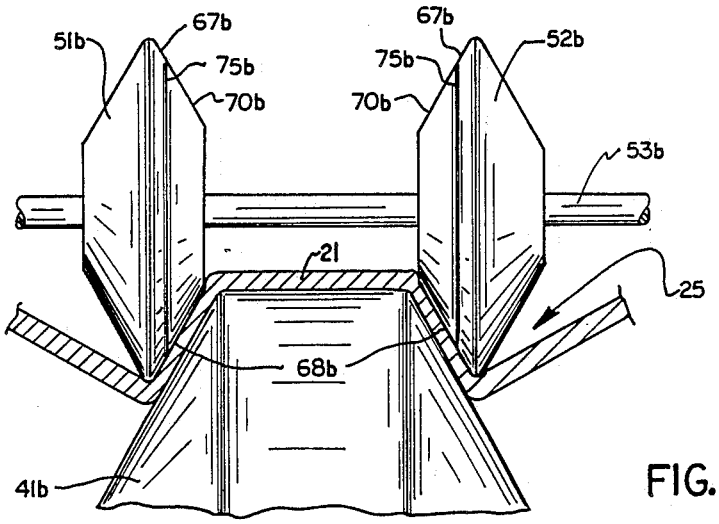
Figure 6:
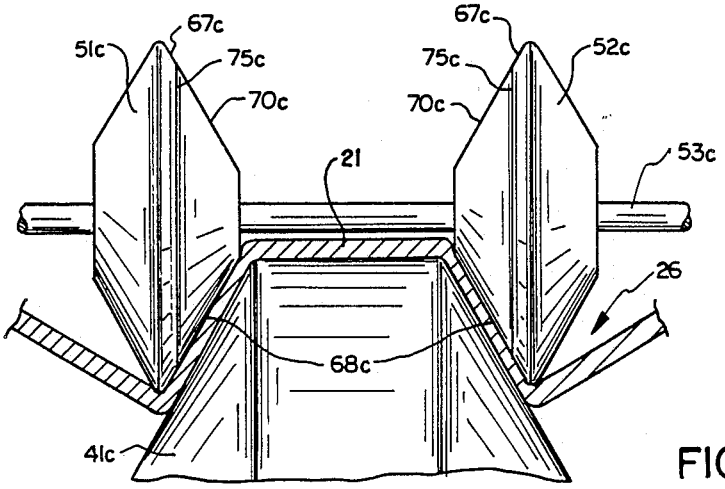

The thinned bands 68 in the strip 21 are progressively widened at the subsequent work stations 24–26, as indicated by reference numerals 68*a–c* in FIGS. 4–6, respectively, until a strip configuration having diverging walls of the desired width is produced. Power driven mandrels 41*a–c*, which are preferably indentical to the above described mandrel 41, are provided at the work stations 24–26, respectively. A pair of cooperating pressure rollers is provided at each work station for cooperation with the mandrel to shear deform and thin the metal of the strip 21 in a manner similar to that described above in connection with the operation of pressure rollers 51, 52.

Referring specifically to FIG. 4, the pressure rolls 51*a*, 52*a* are mounted on a rotatable shaft 53*a* which is loaded by hydraulic actuators (not shown) similar to the actuators 56, 57 shown in FIG. 3. Each of the pressure rolls 51*a*, 52*a* has a frustoconical working surface 67*a* which corresponds to the working surfaces 67 of the pressure rolls 51, 52. Extending radially inwardly from the inner edge 75*a* of the working surface 67*a* is a second surface 70*a*, which overlies the portion of the strip 21 that was thinned at the previous work station 23. The surface 70*a* is stepped back or relieved from 75*a* with respect to the surface 67*a*, i.e., away from the adjacent surfaces of the mandrel 41*a*, by a small amount, e.g., 0.003–0.005 inches. The second surface 70*a* functions to prevent back extrusion of the metal toward the unreduced central area of the strip. The slight relief of the roll areas 70*a* avoids coining of the previously reduced wall areas 68 while still confining the metal and preventing back extrusion.

As shown, the pressure rolls 51*b*, 52*b* at the work station 25 (FIG. 5) are similar to the pressure rolls 51*a*, 52*a* of FIG. 4 except that the relieved surfaces 70*b* are wider than the surfaces 70*a* in order to overlie all of the metal thinned at the previous work stations 23, 24. Similarly, the relieved surfaces 70*c* of the pressure rolls 51*c*, 52*c* at the work station 26 (FIG. 6) are widened to overlie all of the metal thinned at the previous three work stations.

In most cases, it is desirable to perform the shear deformation so that the thinned band which is progressively formed is substantially uniform in thickness. However, some irregularity in the thickness of such band results from manufacturing tolerances and because multiple passes are provided. Further, in some instances it may be desired to vary the width of the throat between adjacent rolls to cause variation in the thickness of the band. When referring to a thickness $T_2$, it should be understood that a thinned band having a thickness $T_2$ includes bands which are not completely uniform in thickness.

The operation of the apparatus of this invention will be largely apparent from the foregoing description. The metal strip 21 of indefinite length is moved in continuous fashion through the several work stations 23–26. At the work station 23, portions 68 of the strip 21 are bent out of the its original plane by the coaction of the pressure rolls 51, 52 with the mandrel 46 and are thinned by the application of the shearing force 71, which causes the metal to yield laterally, i.e., edgewise, with minimum or no elongation.

In the preferred operation of the apparatus, the angle A is maintained constant and the strip is thinned to a thickness no less than the original thickness times the sine of angle A in order to avoid longitidinal flow or cracking of the metal. As the strip passes from one work station to the next, the pressure rolls of each subsequent work station engage metal that has not been thinned and is adjacent to the previously thinned band, whereby the width of the thinned band of metal is progressively increased until the desired width is reached.

Because the two pressure rolls at each work station are symmetrical and apply substantially equal and opposite forces to the metal, the guiding action provided by the angles in the strip that engage the mandrel is sufficient to guide the strip, and it is not necessary to provide separate guiding structure.

In the described embodiment, the strip 10 is roll-formed in symmetrical fashion so that the thickness reduction and the width of the thinned bands are equal. In such a case, it is preferable to utilize the illustrated symmetrical mandrel having a cylindrical central portion and frustoconical sides having an equal cone angle. It is within the broader aspects of the invention to produce members which may not be symmetrical, e.g., two separate longitudinal portions or bands may be required that have different amounts of thinning or different lateral widths. In such instances, the mandrel may be constructed so that the central portion is eliminated or is non-cylindrical. Further, the sides of the mandrel may have different cone angles or be non-conical. Still further, the pressure rolls may be journaled for rotation about axes which are not parallel to the mandrel axis, or the hydraulic actuators which load the pressure rolls may be arranged to provide a different force vector direction to change the angle B.

Normally, the mandrels are driven by a power source (not illustrated). The force applied to the pressure rolls by the actuators is adjusted to ensure that yield occurs and to produce the desired amount of thinning.

It is preferable to utilize actuators which are preferably hydraulic actuators, and to supply them with a system that provides some spring action so that variations in thickness of the material being worked will not drastically alter the forces applied. For example, if the shaft 53 were mechanically locked in a given position, small changes in thickness of the strip should create drastically fluctuating forces in the system. When the force of the pressure rolls is applied by a system which allows some floating of the rolls with variations in thickness of material, the shear forces are substantially uniform and a uniform ratio of shear deformation is achieved.

In practice, it has been determined that the amount of reduction achieved in successive work stations gradually decreases. It is believed that this results from work hardening of the metal immediately beyond the zone being shear-deformed. In fact, the metal immediately beyond the radiused portion 66 often tends to increase in thickness slightly.

Because the metal laterally beyond the pressure rolls at each work station often tends to increase in thickness, it is apparent that lateral extrusion or metal flow is occurring, causing some work hardening of the metal which is subsequently thinned in the next subsequent work station. This work hardening is believed to be the cause of the gradual increase of the thickness of the thinned portion produced in successive work stations.

In order to overcome this problem of increasing thickness of the thinned portion, a method of roll forming in accordance with the second embodiment of this invention illustrated in FIGS. 12 through 18 may be utilized.

Figure 15:
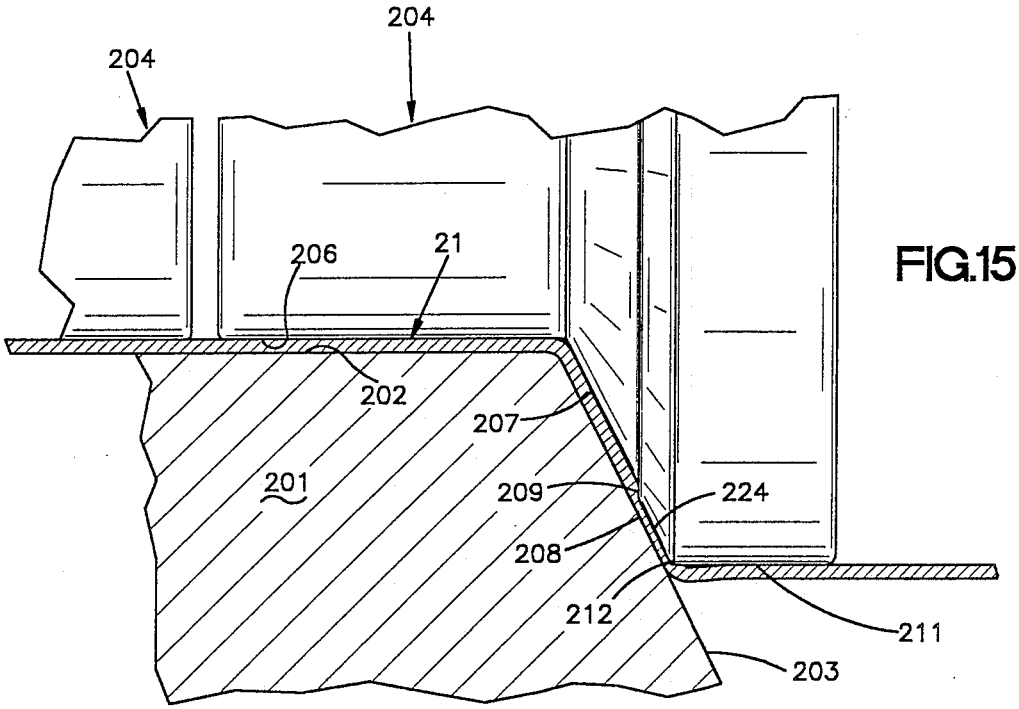
FIG. 15 is a schematic, fragmentary cross section of a first work station in accordance with the second embodiment at which the initial thinning operation occurs.
Figure 16:
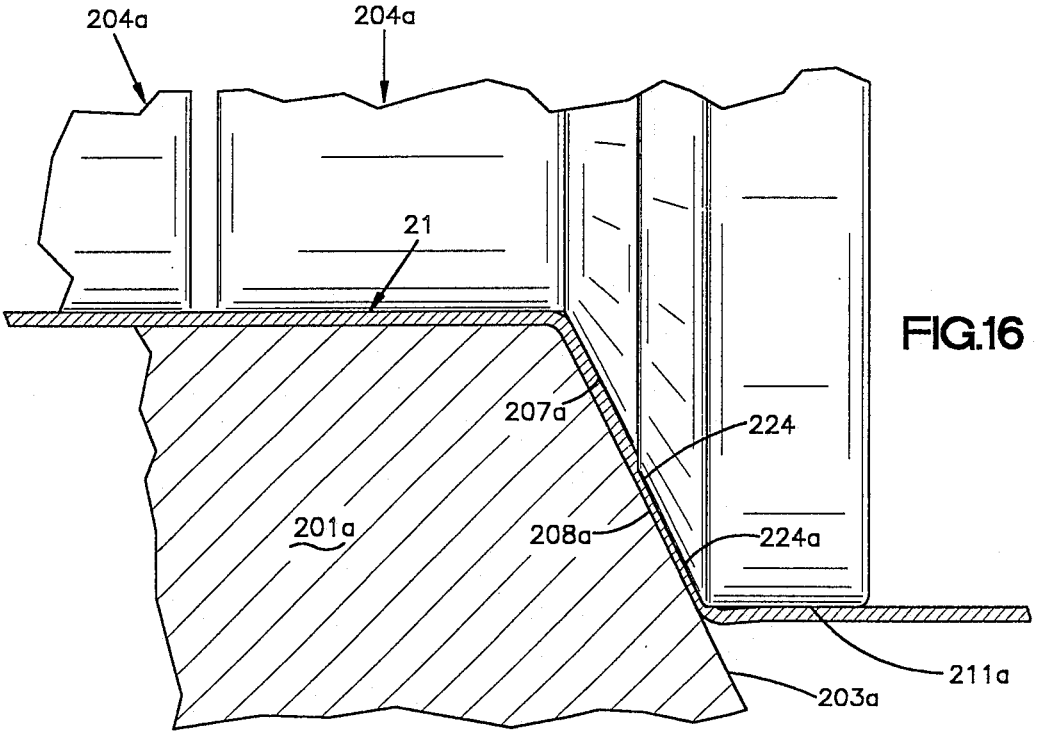
FIG. 16 is a schematic, fragmentary cross section at a second work station in accordance with the second embodiment of this invention.
Figure 17:
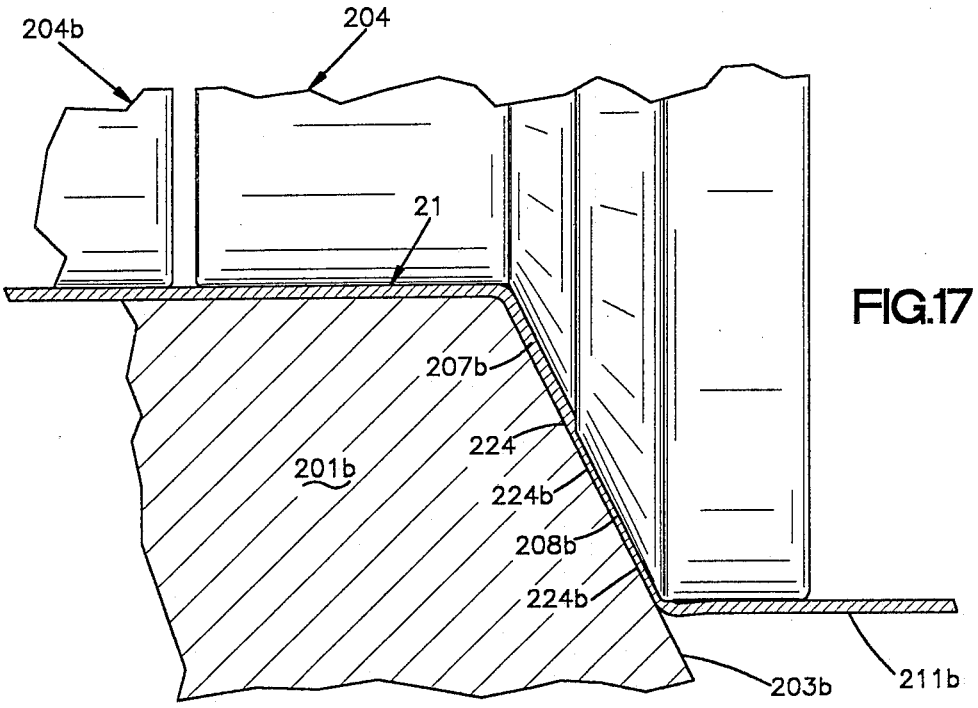
FIG. 17 is a schematic, fragmentary cross section of a third work station in accordance with the second embodiment of this invention.

In accordance with such second illustrated embodiment, the strip of metal 21 is sequentially passed through a first group of three work stations, as illustrated in FIGS. 15, 16, and 17. In the first work station illustrated in FIG. 15, a mandrel 201 is again provided with a cylindrical outer surface 202 and a pair of opposed and similar frustoconical surfaces 203, similar to the mandrels of the first embodiment. However, only one surface 203 is illustrated to simplify the drawings.

In this embodiment, the pressure rolls 204 are provided with a cylindrical portion 206 spaced from the cylindrical portion 202 of the mandrel by a distance approaching the original thickness of the strip of metal 21. Here again, two similar and opposite pressure rolls 204 are provided which are centered with respect to the mandrel 201 so that one pressure roll 204 works one side of the strip and the other pressure roll 204 cooperates with the opposite side of the mandrel to work the other side of the strip.

Each of the pressure rolls 204 is provided with a frustoconical surface 207 spaced from the associated conical surface 203 and joining at its inner end with the cylindrical surface 206. Here again, the spacing between the conical surface 207 on the pressure rolls 204 and the adjacent portions of the conical surfaces 203 is selected to be substantially equal to the original thickness of the strip 21, so that no thinning of the metal of the strip is produced by the conical surfaces 207.

Radially beyond the conical surfaces 207 is an associated frustoconical working surface 208 joined to the conical surface 207 by a radial surface 209. As illustrated, the spacing between the conical working surface 208 and the adjacent conical surface 203 of the mandrel 201 is less than the original thickness of the strip of metal 21, and is substantially equal to the reduced thickness desired. It should be understood that the mandrel 201 and the two pressures rolls rotate about parallel axes in a manner similar to the first embodiment, and that the pressure rolls are urged downwardly by similar piston and cylinder actuators.

As the strip of metal 21 passes through the work station between the pressure rolls and the mandrel, the conical working surface 208 engages the adjacent portion of the strip and causes deformation of such portion to produce a longitudinally extending, thinned band 224 which is relatively narrow.

Here again, the forces on the metal cause lateral flow of the material without any significant longitudinal flow, so the strip remains straight. The portion of the metal above the conical portions 208 as illustrated in FIG. 15 is substantially confined by the conical portions 207 and the cylindrical portions 206, so backward extrusion or backward flow of the metal of the strip is prevented. Consequently, the deformation results in lateral outward flow of the material of the strip. In this instance, the pressure rolls are provided with a cylindrical portion 211 joined to the conical working surface 208 by a radius at 212 so that the flanges extend substantially parallel to the central portion of the strip rather than perpendicular to the inclined portion, as illustrated in the first embodiment.

In the second working station, a similar mandrel **201*a* is again provided along with two pressure rolls 204*a*, as illustrated in FIG. 16. Pressure rolls 204*a* differ from the rolls of the first working station of FIG. 16, in that the lateral width of the conical working surface 208*a* is increased so that it extends beyond the thinned portion formed at the first working station and laterally deforms the material of the strip at 224*a* immediately adjacent to the thinned portion 224 formed in the first work station to increase the total width of the thinned portion or band. Here again, the portion of the conical working surface aligned with the previously thinned band deformed at the first work station of FIG. 16 is substantially confined so that backward extrusion cannot occur and the deformation of the newly worked portion of the strip occurs in a laterally outward direction along the angle of the conical surface 203*a* of the mandrel 201*a***. Again, this lateral deformation of the strip material occurs without any significant longitudinal flow and the strip remains straight.

The third work station illustrated in FIG. 17 again widens the thinned bands 224 and **224*a* in a similar manner. The pressure rolls 204*b* have a conical working surface 208*b* which is wider than the conical working surface of the pressure rolls in the second work station of FIG. 17, so additional lateral flow is produced and the thinned bands 224 and 224*a* are increased in width, as indicated at 224*b*. It has been found that when processing cold-rolled common quality steel, three sequential work stations can be utilized to progressively widen the thinned band without any substantial reduction in the thickness believed to be caused by work hardening. However, if additional similar progressive work stations are provided, the amount of reduction in thickness of material diminishes a significant amount. Therefore, a fourth work station as illustrated in FIG. 18** is arranged to skip over a narrow part of the unworked portion of the strip material so as to engage the strip along a band which is unaffected by the previous rolling operation.

Figure 18:
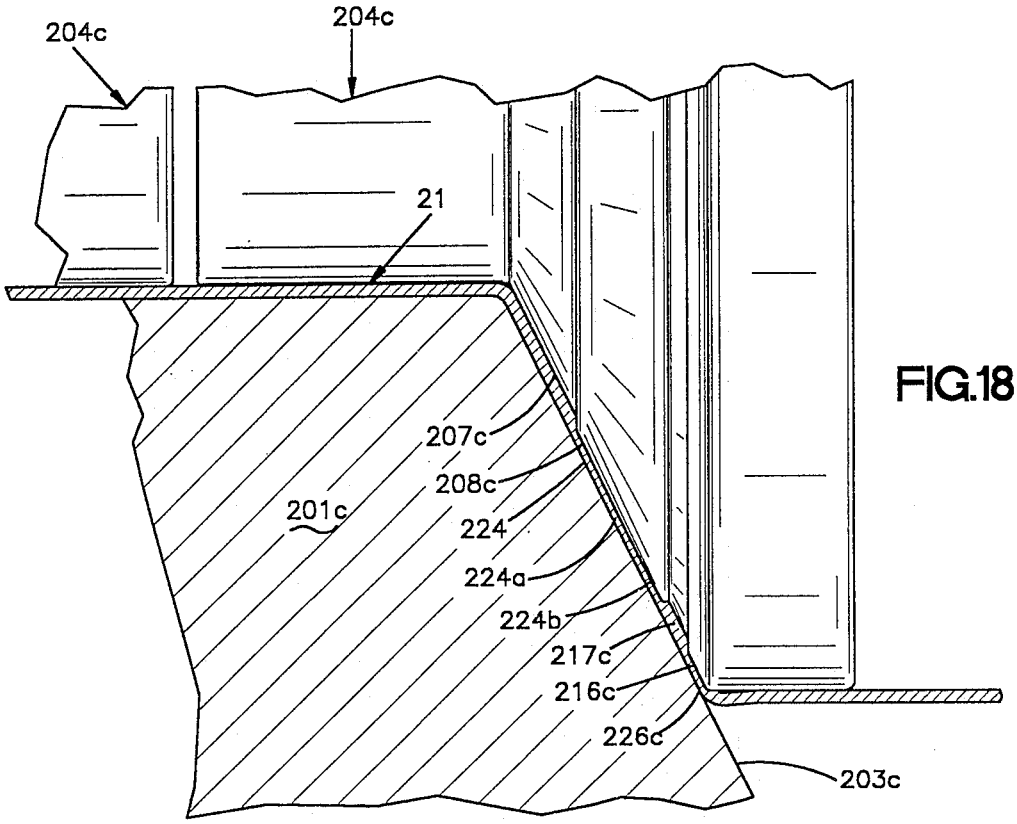
FIG. 18 is a fragmentary, schematic cross section of the fourth work station which commences the formation of an associated second thinned band after skipping over an unthinned portion of strip material.

The pressure rolls of the fourth work station illustrated in FIG. 18 are provided with a cylindrical surface 206c, a conical surface 207c, and a conical surface 208c, which corresponds dimensionally to the corresponding surfaces of the third work station of FIG. 17. However, the pressure rolls 204c are provided with a conical working surface 216c spaced from the conical surface 208c by a relieved portion 217c. At this work station, the material is confined laterally inward except for the relief portion, and a second narrow band of thin material 226c is formed longitudinally of the strip. Because the material of the strip of metal which is engaged by the conical working surface 216c has not been previously work-hardened, full reduction in thickness can be again achieved.

Normally, the strip of material is then passed through additional work stations (not illustrated), which would progressively increase the width of the second band 226c of thinned material in the same manner as the first band. If the total width of thinned material requires additional skipping action, subsequent work stations are provided with a similar relief section so that a second skip over the work-hardened material is provided.

In the illustrated embodiment of FIGS. 15–18, three successive passes are illustrated before a skipping operation. It should be understood, however, that greater or lesser numbers of sequential passes can be provided between skip-overs, depending upon the material and thickness being formed and upon the amount of thickness reduction required. Therefore, this invention is not limited to skips occurring after three non-skipping operations.

FIG. 12 illustrates a strip of material 220 formed in accordance with the second embodiment, which corresponds to a considerable extent to the strip of material illustrated in FIG. 1. Here again, the strip is provided with a central wall portion 221 having a thickness $T_1$, the same as the original thickness of the strip. In this embodiment, the member or strip 220 is again provided with laterally diverging wall portions 222 which again terminate in edge flange portions 223. In this instance, the flange portions extend substantially parallel to the central wall portion 222 because the pressure rolls are provided with cylindrical surface 211 through 211c, which maintain such orientation.

In this embodiment, however, the lateral diverging wall portions 222 are provided with a first band of reduced thickness 224–224b and a second band of reduced thickness 226c on either side of a rib-like portion 227. The first thinned band in this illustrated embodiment is formed at the first three work stations illustrated in FIGS. 15 through 17 and the second thinned band 226c is formed at the work station of FIG. 18 and by subsequent work stations (not illustrated) which progressively widen such band. Because of the skip-over which results in the rib-like portion 227, substantially uniform thinning is achieved in the two bands, so efficient thinning operations are achieved even though a small, very narrow rib-like portion exists.

FIG. 13 is a greatly enlarged cross section, taken along the plane 13—13 of FIG. 12. It should be noted that the two thinned bands 224–224b and 226c have a substantially uniform thickness $T_2$, and that the flanges 223 and the central wall portion 221 remain at substantially the original thickness of the strip. It should also be noted that the rib-like portion 227 appears to be folded or buckled at 231 a small amount. This is believed to be caused by a small amount of backward extrusion occurring after the skip-over during the operation occurring in the fourth work station of FIG. 18. Since the metal is not fully confined immediately behind the conical working surface 216c, because of the relief portion 217c, some backward extrusion occurs.

FIG. 14 illustrates the manner in which the buckling tends to occur in the rib-like portion 227. As best illustrated in such figure, the bucking tends to occur with a herringbone-like pattern 232 in which the buckling portions 31 are inclined and overlapped. Consequently, a herringbone-like pattern. It is believed that this herringbone-like pattern occurring in the buckled portion results from residual stresses in the material resulting from the thinning operations occurring prior to the skip-over. When the buckling occurs, it permits these internal stresses to be relieved and create the herringbone-like pattern in the rib portions 227. Although the rib portion is somewhat irregular, it provides a desirable stiffening action along the thinned portion of the metal.

One specific example of the invention involves room temperature rolling of a steel strip 2.559 inches in width and 0.015 inches in thickness. The strip was prepainted, cold-rolled, common quality steel. It was lubricated by the application of oil soap and was shear reduced in 12 passes to form two thinned bands. Each thinned band had a thickness of 0.009 inches and a width of 0.915 inches. The angle A was 28° and the percent reduction was approximately 40%. The edge-to-edge surface width of the rolled strip was 3.300 inches.

Another example of the invention involves room temperature rolling of a non-coated, dead soft aluminum strip 2.359 inches wide and 0.023 inches thick. The aluminum strip was shear reduced to form two laterally spaced bands each having a reduced thickness of 0.015 inches and a width of 0.915 inches. The angle was 28° and the percent reduction was approximately 35%.

In each of the above examples, the ratio of $T_2$ divided by $T_1$ was greater than the sine of the angle A. Therefore, such reduction was performed by shear deformation. However, another specific example resulted in reduction exceeding the ratio established by the sine of the angle A. In such example, a strip of common quality steel having an original thickness of 0.013 inch was rolled at room temperature in accordance with the second embodiment discussed above. Here again, the cone angle of the rolls was 28 degrees. The first thinned band 224, 224c had a thickness varying between 0.0028 inch and 0.0046 inch. The second band 226 had a thickness varying between 0.0034 inch and 0.006 inch. In such example, the ratio of $T_2$ divided by $T_1$ varied between about 21% and 46%. Therefore, the amount of reduction exceeded the sine of the 28-degree angle to a considerable degree. Even so, there was no cracking or tearing of the metal and the strip remained straight.

It is believed that in this example the initial deformation involved only shear deformation and that further flow occurred beyond the sine of the angle A without sufficient longitudinal flow to produce objectionable loss of the straightness of the resulting strip. Consequently, even the deformation beyond the pure shear deformation was substantially all in a lateral direction.

This lateral direction of the metal flow resulted from the fact that the area of contact between the rolls and the metal strip along the zone of deformation 241, illustrated in FIG. 19, was substantially longer, as indicated by L, in the direction of the length of the strip 21, indicated by the arrow 242, than it was wide, as indicated by W, in the lateral direction. As illustrated, the length L was at least three times W. In such instance, in which the working contact between the strip and roll is relatively long in the direction of length of the strip and narrow in the lateral direction with respect to the length, the friction forces applied to the metal of the strip restrain longitudinal deformation while permitting relatively small resistance to lateral deformation. Consequently, substantially pure lateral deformation of the strip occurs even through the forces exceed the forces producing simple shear deformation and the thinning ratio exceeds the sine of the angle A. In most instances, however, particularly when relatively thin sheet metal is being provided with longitudinally extending bands of reduced thickness, the thinning ratio should be equal to greater than the sine of the angle A so that relatively easy shear deformation is provided.

Figure 7:
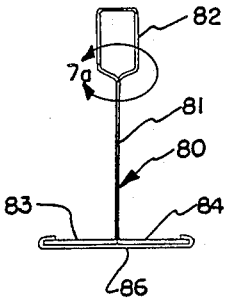
FIG. 7 is a cross section of a grid tee for a suspension ceiling in accordance with the present invention.
Figure 7A:
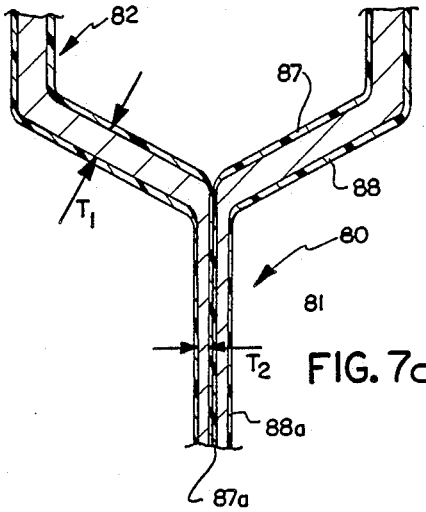
FIG. 7*a* is an enlarged, fragmentary cross section of the grid tee of FIG. 7.

FIGS. 7 and 7*a* illustrate a grid tee 80 for suspension ceilings and the like in accordance with the present invention. Such grid tee provides a single unitary strip of metal bent to provide a central web 81, a stiffening bulb 82 along the upper edge of the web 81, and opposed panel supporting flanges 83 and 84 along the lower edge of the web 81. In the particular grid tee illustrated in FIG. 7*a*, a separate cap 86 is mounted on the flanges on the side thereof remote from the web 81. However, in many instances, a separate cap is not required and the entire grid tee is formed by bending a single strip of metal.

The grid tee 80 is preferably formed from a cold-rolled elongated member, such as the menber 10 illustrated in FIG. 1 or the member 220 illustrated in FIG. 12. In such case, the grid tee 80 is preferably formed so that the entire bulb 82 is formed of the material formerly in the central portion 11 and has a thickness $T_1$. The two layers of the web 81, on the other hand, are formed of the material formerly in the diverging walls 12, 13, and have a layer thickness of $T_2$. The flanges 83 and 84 are preferably formed from the flanges 16, 17 of the elongated member 10, and have a thickness equal to $T_1$.

By roll-forming a grid tee in this manner from a single metal strip which has been previously provided with zones of reduced thickness by the above-described deformation, it is possible to produce a grid tee in which the metal is concentrated in the bulb and flange extremities of the grid tee, while reducing the amount of metal present within the web. As mentioned previously, the web does not contribute materially to the strength of the structure, so the reduction in thickness of the two layers of the web results in metal saving without any significant loss in structural strength. For example, in a grid tee in which the bulb 82 is about one-quarter inch wide, the bulb has a height of about one-half inch, the web has a height of about one inch, and the flanges have a total width of slightly less than one inch, the width of single strip of metal required to form the grid tee is almost 4.5 inches.

If the metal used to form the principal structure of the grid were formed of a uniform thickness, the total amount of metal per unit length of the strip would be substantially equal to 4.5 times such thickness. If, on the other hand, the web is formed with a thickness equal to one-half the thickness of the bulb and flanges, the width of the strip of metal needed to form the tee is about 3.5 inches, so that the total amount of metal is equal to about 3.5 times the initial thickness per unit length. The resulting strip with thin web, therefore, has a metal content percentage determined by dividing 3.5 by 4.5, or about 78% of the metal required to form a grid tee with a uniform thickness web. Therefore, the savings in such a structure would amount to roughly 22%.

The amount of metal saving is a function of the amount of thinning and the width of the thinned portion. In the above example, a 22% saving is obtained with a 50% reduction in thickness. For a given application, if the percentage of reduction is reduced, the metal saving is reduced.

In accordance with still another feature of this invention, it is possible to produce deformation of the metal of a strip which has been previously provided with a coating without destruction of the coating. For example, it is customary to form grid tees of precoated metal, and it has been found that such strips of precoated metal, which are usually coated with a paint or hot-dipped zinc, may often be processed to produce the thinned section by shear deformation without destroying the coating. Referring specifically to FIG. 7*a*, the coatings 87, 88 provided prior to the shear reduction processing and prior to the forming of the grid tee remain at their initial thickness in those zones which are not reduced in thickness. However, the thickness of the coatings 87, 88 along the web portion 81, as indicated at 87*a*, 88*a*, is less than the thickness of the coating along the bulb and flanges.

The ability to reduce the thickness of precoated metal is of considerable importance when manufacturing many structures, since the metal forming the structure can be easily coated in the flat state, and subsequently formed. Further, in many instances, a coating on the metal actually improves the reduction process, since it tends to reduce galling and pick-up on the pressure rolls and mandrels. However, it is desirable in many cases to perform the reduction in the presence of a coolant and lubricant.

Further, the reduction of the longitudinal portions of the metal functions to increase the hardness thereof. This is also an advantage in many structures. For example, in the grid tee of FIGS. 7 and 7*a*, the web layers, although thinner than the remaining portions of the grid, are hardened by the shear reduction to compensate to some extent for the reduction in strength resulting from the thinning process. Further, in most cases, connectors are provided at the ends of the web of a grid tee to connect with associated grid tee members. See, for example, U.S. Pat. Nos. 3,501,185 and 4,108,563, incorporated herein by reference, which respectively illustrate integral end connectors and separate end connectors riveted to the web. Because the web is hardened, it provides sufficient strength even though the web metal is thinned.

Figure 8A:
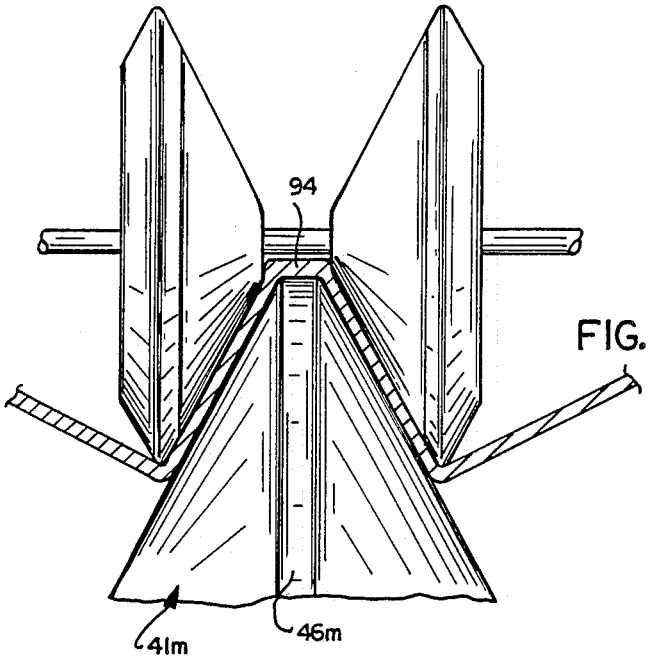
FIG. 8*a* is a schematic, fragmentary cross section of a modified apparatus illustrating the shear deformation used to form the channel of FIG. 8.
Figure 8:
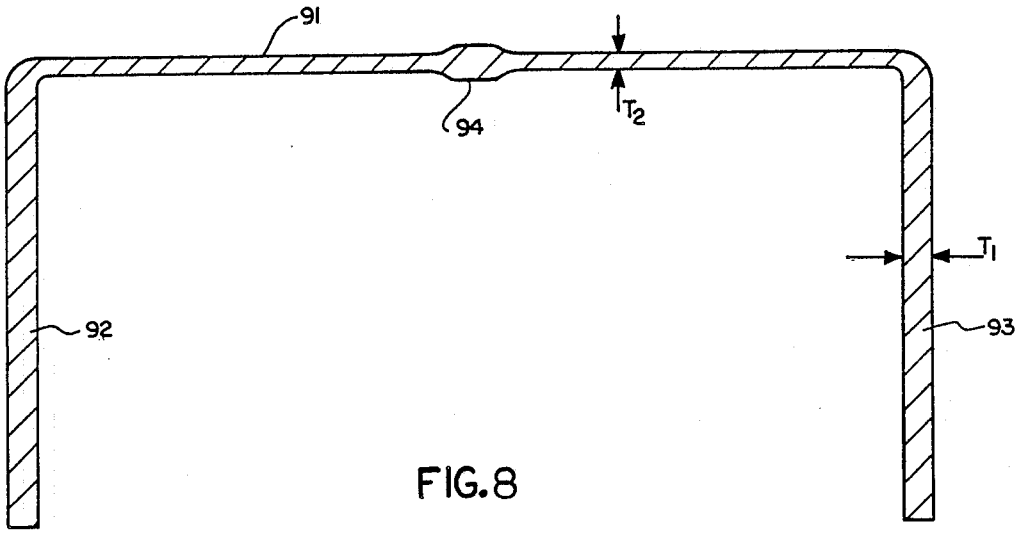
FIG. 8 is a cross section of a U-shaped channel in accordance with the present invention which may be used, for example, as a stud.
Figure 9:
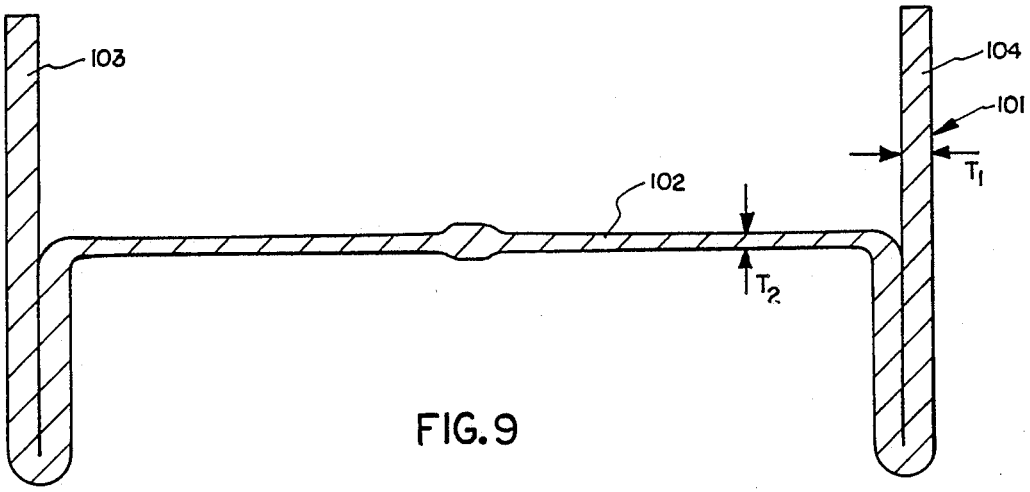
FIG. 9 is a cross section of an H-shaped stud in accordance with the present invention.

FIGS. 8 and 9 illustrate additional structural elements which may be formed in accordance with the present invention. FIG. 8 illustrates a channel-shaped member which may be used, for example, as a drywall stud. Such member is formed of a central web 91 connecting laterally extending flanges 92, 93. As best illustrated in FIG. 8, the thickness $T_1$ of the flanges 92, 93 is substantially equal to twice the thickness $T_2$ of the web, except at the very center portion 94 of the web 91. Here again, the structure is arranged so that the web has reduced thickness and the metal forming the channel is concentrated in the flanges where it provides the greatest structural strength.

Such channel, as illustrated in FIG. 8, may be formed in a manner similar to the elongated member of FIGS. 1 or 12, except that the mandrels (illustrated in FIG. 8*a*) used to support the strip during the shear deformation are shaped to provide a narrow central portion 46 m, so that the web 91 is formed with a reduced thickness for substantially its entire width. Although a coating is not illustrasted on the channel of FIG. 8, such channel can be formed of precoated metal. The coating will have a reduced thickness along the thinned portions in the same manner as the grid tee of FIGS. 7 and 7*a*. Once the deformation is completed, the channel is formed by conventional roll-forming.

FIG. 9 illustrates an H-shaped beam, or I-beam-type structure which may, for example, be used as a drywall stud 101. Such stud includes a central web 102 having a thickness $T_2$ which is substantially less than the thickness $T_1$ of the flanges 103 and 104. Here again, a structure is provided in which metal savings are achieved because the metal forming the stud 101 is concentrated along the flanges where it produces the greatest strength. The H-shaped stud 101 may be formed by a preliminary thinning operation operation as illustrated in FIG. 8*a*, followed by a conventional roll-forming operation to provide the shape of the stud. Again, precoated material may be used if desired, and the coating may be thinned but retained during the deformation process.

Figure 10:
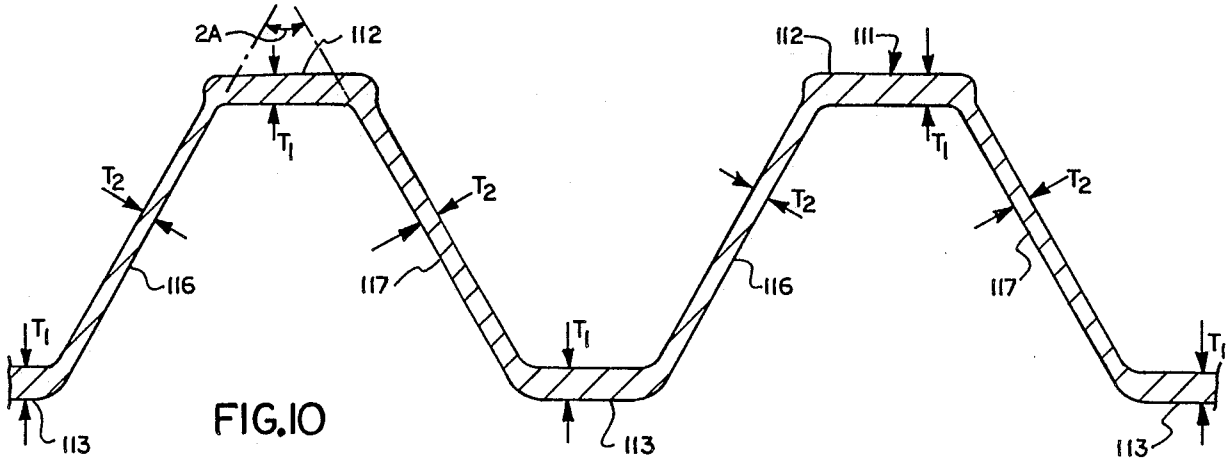
FIG. 10 is a cross section of a portion of a sheet of corrugated metal in accordance with the present invention.
Figure 11:
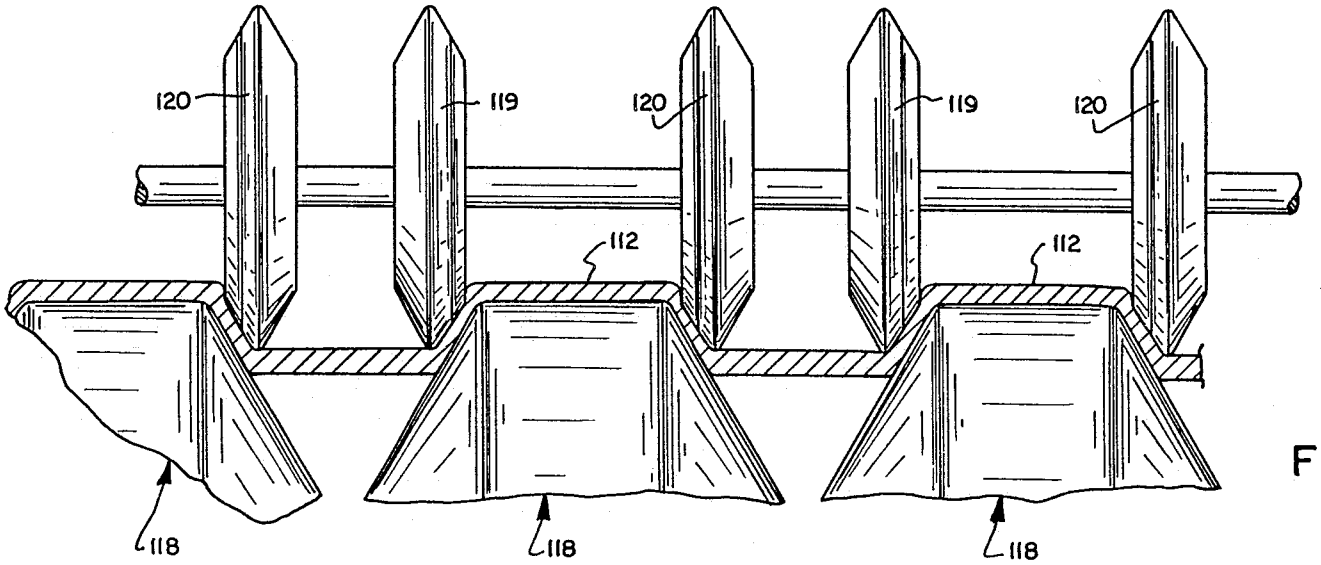
FIG. 11 is a fragmentary cross section, schematically illustrating still another modified apparatus for progressively forming the corrugated metal of FIG. 10.

FIGS. 10 and 11 illustrate a novel and improved corrugated sheet structure and the apparatus for forming such structure. An elongated, corrugated structure 111 is provided with the cross section illustrated in FIG. 10. Such structure includes upper planar portions 112 and lower planar portions 113, all having a thickness $T_1$ which is the initial thickness of the sheet material or strip used to form the corrugated sheet 111. The upper and lower planar portions 112, 113 are joined by inclined webs 116, 117, which have been thinned by deformation as discussed above to provide them with a thickness of $T_2$, which is substantially thinner than the thickness $T_1$.

As discussed above, when the included angle 2A between the diverging associated walls 16, 17 is about 60 degrees, $T_2$, in accordance with the sine rule, can be equal to approximately one-half $T_1$. Because of this relationship of the thickness, the corrugated sheet of FIG. 10 can be conveniently formed progressively with an apparatus schematically illustrated in FIG. 11. In such apparatus, the separate mandrel 118 is provided for each corrugation, and associated pressure rolls 119, 120 are provided for each mandrel 117. It should be understood that FIG. 11 illustrates only one working station, and that subsequent progressive similar working stations are provided to increase the width of the thinned walls until they have a width as illustrated in FIG. 11.

The upper planar portions 112 remain at their initial width and the width of the lower planar portions is reduced as the thinned walls increase in width until they are provided with a width 113 in FIG. 10. During this process, because the thinning is performed in accordance with the sine of the angle A as discussed above, the total width of the strip is not changed. For example, if the initial strip is four feet wide, the resulting corrugated sheet will be about four feet wide, even though the webs have increased width and are inclined with respect to the top and bottom portions 11, 113. Further, when the reduction is in accordance with the sine of the angle A, the spacing between adjacent mandrels remains constant as the thinning progresses.

In some instances it may be desirable to form a corrugated sheet as illustrated in FIG. 10, and then shear the sheet lengthwise into separate strips. As discussed above, a strip that is thinned lengthwise may, in many instances, be an intermediate product used to subsequently roll-form a final required structure.

Although the preferred embodiments of this invention are shown and described, it should be understood that various modifications and rearrangements of the parts may be resorted to without departing from the scope of the invention as disclosed and claimed herein.

What is claimed is:

1. An apparatus for roll-forming sheet metal comprising a mandrel journaled for rotation about the first axis and providing laterally spaced opposed conical surfaces and a generally cylindrical central portion joining said conical surfaces, pressure roll means providing opposite conical peripheral portions substantially adjacent to each of said conical surfaces, and force means operable to apply forces to said pressure roll means in a direction inclined relative to said conical surfaces, said mandrel and pressure roll means cooperating when an elongated piece of sheet metal is longitudinally passed therebetween to apply substantially balanced forces to said sheet metal and shear deform a longitudinally extending portion of said sheet metal along each conical surface to reduce the thickness thereof without substantial longitudinal deformation, and without reducing the thickness of said sheet metal between said longitudinally extending portions.

2. An apparatus as set forth in claim 1 wherein said pressure roll means are journaled for rotation about a second axis substantially parallel to said first axis.

3. An apparatus as set forth in claim 2, wherein said force means provide resilient forces on each of said peripheral portions which are adjustable.

4. An apparatus for roll-forming sheet metal comprising first and second mandrels respectively journaled for rotation about first and second axes, each of said mandrels providing an inclined surface, first and second pressure rolls respectively associated with said first and second mandrels and journaled for rotation about third and fourth axes, said first pressure roll providing a surface portion substantially adjacent to and substantially parallel to said inclined surface of said first mandrel, said second pressure roll providing a surface portion substantially adjacent to and substantially parallel to said inclined surface of said second mandrel, force means operable to apply a force to each of said pressure rolls in a direction inclined relative to said inclined surface, said first mandrel and first pressure roll cooperating when an elongated piece of sheet metal is longitudinally passed therebetween to shear deform a longitudinally extending first band thereof to a reduced thickness without any substantial longitudinal deformation, said second mandrel and second pressure roll cooperating when said elongated piece of sheet metal is thereafter passed therebetween to shear deform a second longitudinally extending band thereof laterally with respect to said first longitudinally extending band to increase the width of the portions of reduced thickness without substantial longitudinal deformation of said sheet metal and without substantial further reductions in thickness of said first band.

5. An apparatus as set forth in claim 4, wherein said first and third axes are contained in a single plane and are substantially parallel, and said second and fourth axes are contained in a single plane and are substantially parallel.

6. An apparatus as set forth in claim 4, wherein said first and second longitudinally extending bands abut and cooperate to form a single longitudinally extending portion of reduced thickness.

7. An apparatus as set forth in claim 4, wherein said first and second longitudinally extending bands are laterally spaced from each other by a portion of said sheet metal remaining at the original thickness thereof.

8. An apparatus as set forth in claim 4, wherein said force means provides resilient forces allowing said pressure rolls to float and compensate for variations in thickness of said sheet metal.

* * * * *

UNITED STATES PATENT AND TRADEMARK OFFICE

CERTIFICATE OF CORRECTION

PATENT NO. : 4,969,346

DATED : November 13, 1990

INVENTOR(S) : George F. Bosl et al.

It is certified that error appears in the above-identified patent and that said Letters Patent is hereby corrected as shown below:

Column 12, lines 10-11, "Consequently, a herringbone-like pattern." should read --Consequently, the buckle illustrated in FIG. 13 is irregular in a herringbone-like pattern.--

Signed and Sealed this

Seventh Day of April, 1992

*Attest:*

HARRY F. MANBECK, JR.

*Attesting Officer*

*Commissioner of Patents and Trademarks*